US006192651B1

(12) United States Patent
Donaldson

(10) Patent No.: US 6,192,651 B1
(45) Date of Patent: Feb. 27, 2001

(54) METHOD OF FORMING FOAM-FILLED DECORATIVE MUNTIN BAR FOR WINDOWS AND THE LIKE

(75) Inventor: John K. Donaldson, Oakville (CA)

(73) Assignee: Bay Mills Limited, Ontario (CA)

( * ) Notice: Subject to any disclaimer, the term of this patent is extended or adjusted under 35 U.S.C. 154(b) by 0 days.

(21) Appl. No.: 09/502,057

(22) Filed: Feb. 10, 2000

Related U.S. Application Data

(62) Division of application No. 08/928,727, filed on Sep. 12, 1997, now Pat. No. 6,035,597.

(51) Int. Cl.[7] ..... E04B 1/00
(52) U.S. Cl. ..... 52/742.13; 52/456
(58) Field of Search ..... 52/742.1, 742.13, 52/745.19, 456, 655.1

(56) References Cited

U.S. PATENT DOCUMENTS

| | | |
|---|---|---|
| 3,686,814 | 8/1972 | Anderson . |
| 3,946,531 | 3/1976 | Armstrong . |
| 4,060,950 | 12/1977 | Rackard et al. . |
| 4,145,858 | 3/1979 | Dovman . |
| 4,564,540 | 1/1986 | Davies et al. . |
| 4,580,380 | 4/1986 | Ballard . |
| 4,586,306 | 5/1986 | Webb . |
| 4,652,472 | 3/1987 | Davies . |
| 4,702,055 | 10/1987 | Ralph . |
| 4,723,388 | 2/1988 | Zieg . |
| 4,901,493 | 2/1990 | Thorn . |
| 4,970,840 | 11/1990 | Ouellette et al. . |
| 5,267,421 | 12/1993 | Salisbury . |
| 5,285,612 | 2/1994 | Johnson . |
| 5,345,743 | 9/1994 | Baier . |

OTHER PUBLICATIONS

Harvey J. Arbuckle, "New Roll Forming Line Fulfills 15 Year Dream of Quality" *Metal Forming*Jul. 1995, pp. 29–32.

*Primary Examiner*—Beth A. Stephan
(74) *Attorney, Agent, or Firm*—Fitzpatrick, Cella, Harper & Scinto

(57) ABSTRACT

A method of forming a foam-filled decorative muntin bar includes the steps of roll-forming a sheet of aluminum to form a hollow outer shell, and depositing a mixture of foaming components on the sheet of aluminum as it is being roll-formed, so the outer shell encases the mixture. The mixture is allowed to react, expand and harden to form a foamed material that substantially fills the shell. The filled shell is cut to form a segment of a foam-filmed decorative muntin bar of desired length with open ends.

7 Claims, 6 Drawing Sheets

METHOD OF FORMING FOAM-FILLED DECORATIVE MUNTIN BAR FOR WINDOWS AND THE LIKE

This application is a divisional of application Ser. No. 08/928,727, filed Sep. 12, 1997 now U.S. Pat. No. 6,035,597.

FIELD OF THE INVENTION

The present invention relates to a decorative muntin bar assembly for windows, doors and the like, and more particularly to a muntin bar assembly in which hollow muntin bars are filled with a foamed material.

BACKGROUND OF THE INVENTION

At one time, large windows, glass doors and the like had to be made up of multiple small glass panes, held in place by structural grids called muntin bars. Now that windows can be formed less expensively, for example, from a single large glass sheet, muntin bars are used as decorative features to simulate classic multiple pane windows. Although muntin bars are sometimes commonly referred to as colonial bars, georgian bars or grill bars, I will refer to these decorative features as muntin bars. Also, although these decorative muntin bars are useful in windows, doors and the like, I will refer to their use in windows, for ease of discussion.

A decorative muntin bar grid is generally attached to a frame or spacer at the perimeter of the window and can be either mounted between parallel panes of glass in a window, as in an insulative glass (IG) unit, or on the inside or outside surface of the window.

Decorative muntin bars are generally constructed from aluminum, another suitable metal, or a suitable plastic. In the case of aluminum or other metal, the muntin bars are commonly roll-formed by a continuous process in which a flat strip is rolled into an elongated hollow bar, creating a seam where the ends of the flat strip are brought together. Individual muntin bars are then cut from this elongated bar. Muntin bars can also be extruded or, particularly in the case of plastic, pultruded. Pultrusion is similar to extrusion, except that the material in pultrusion is drawn, rather than pushed, through a die. Regardless of the formation process, muntin bars are typically hollow, with a uniform (often flat rectangular) cross section.

A muntin bar grid is typically assembled in one of two ways. In one arrangement, a joining element is provided at each intersection of the grid. A number of short muntin bar segments are joined together at their ends by each of these joining elements. Each joining element has a number of extensions which are friction fit into the ends of the segments. U.S. Pat. No. 4,723,388, entitled "Easily Formable Grid for Windows and the Like", to Zieg, illustrates an example of such a structure.

In the other common arrangement, longer bar segments are overlapped to form the grid. Overlapping bars are provided with complementary notches so that the bars can interfit at each intersection into a relatively flat unit. Concealed joiners sit within the notches at each intersection and extend into each of the overlapped bars to hold the bars together. U.S. Pat. No. 4,060,950, entitled "Concealed Clip for Hollow Strips", to Rackard et al., shows an example of such a muntin bar assembly.

Muntin bars are generally joined to a frame or spacer by using end-pins which fit into corresponding holes in the spacer. The end-pins are typically provided in an assembly which is friction fit into the end of each muntin bar. A flange on the assembly abuts the end of each muntin bar to prevent the-assembly from being forced too deeply into the muntin bar.

Traditional muntin bars, particularly those of the overlapping assembly type, suffer from several structural and aesthetic drawbacks. The notches at the intersection points are generally formed by a notching jig or punch which stamps out each notch after the bar has been formed, often damaging the material surrounding the notch. The muntin bars, especially those that are notched, are also prone to bending during preinstallation handling. Further, the concealed joiners used with notched bars are difficult to handle, making the joining process labor intensive and increasing the likelihood of damaging the bar. If the muntin bars are too flimsy and are deflected during or after installation, they can damage any interior coating of the glass. In the case of a roll-formed muntin bar, friction fitting the end-pin assembly into the end of the bar often forces the seam open, which is unsightly and detrimental to the structural integrity of the assembly. This can also be true of the joining elements used in non-overlapping grid arrangements. In addition, the flange of the end-pin assembly will often be visible at the end of the muntin bar, undermining the aesthetic effect.

Most of the above-noted structural problems can be addressed by forming the muntin bar from sufficiently thick or sturdy stock material. However, using thicker material is not only more expensive and less attractive, but also to some extent undermines the insulative properties of an IG unit. To a degree, the thicker the material of the muntin bar is, a greater conduit is provided for heat transfer, and the poorer the thermal insulation provided by the window.

The seam of the roll-formed bar can also be prevented from spreading by welding, which also provides some structural rigidity to the overall bar. However, welding the seam adds another production step, further increasing production costs. Welding also presents aesthetic problems. In order to avoid an unsightly welded seam, the welding must be done internally or the seam must be treated after welding, either of which adds to the cost of production.

Attempts have been made to reinforce hollow bar or beam structures, none of which is wholly satisfactory for use with muntin bars. For example, U.S. Pat. No. 5,285,612, entitled "Interlocking Joint with Notch Reinforcement", to Johnson, relates to notched beams which interlock to form a rigid joint without fasteners. Insert bodies, with notches conforming to the notches in the beams, are inserted into the beams to reinforce the notched areas. However, these inserts do not reinforce the beams during the notching process, nor do they reinforce the portions of the beams remote from the notches.

U.S. Pat. No. 4,580,380, entitled "Composite Filled Interior Structural Box Beams", to Ballard, relates to a composite structural beam with two duplicate flange members and two duplicate web members interconnected in a box form. A lightweight, space-filling bulk substance, such as a foamed plastic, fills the structural beam. While well suited for structural beams, this arrangement is too complex and expensive to be used in a muntin bar assembly.

Foam filling, such as that discussed in the Ballard patent, has been employed in roll-formed products in other industries. For example, rollup storm shutters have been roll-formed and foam-filled, as described in an article entitled "New Roll Forming Line Fulfills 15 Year Dream of Quality", by Harvey J. Arbuckle, appearing at page 29 of the July 1995 issue of *MetalForming,* and which is incorporated herein by reference. However, foam filling has not been applied to muntin bar assemblies.

Thus, there is a need in the art for a decorative muntin bar for windows and the like which is reinforced during notching to prevent collateral damage. There is a further need for a muntin bar with a reinforced seam and/or an end-pin assembly which does not impart as much seam-spreading force as traditional end-pin assemblies. Further, there is a need in the art for a mechanism to reinforce the muntin bar, especially the notched portion thereof, during preinstallation handling. There is also a need to reinforce the overall bar so that the bar material and the bar itself can be made thinner. There is a further need to facilitate the joining or interconnection (hereinafter "joinder") of muntin bars to one another and to a peripheral frame. There is an additional need for a muntin bar in which an end-pin can be seated within the muntin bar, improving the overall aesthetic appearance of the bar.

SUMMARY OF THE INVENTION

The muntin bar of the present invention addresses the forgoing needs in the art by providing a foam-filled decorative muntin bar for windows and the like.

In one aspect, the present invention relates to a foam-filled decorative muntin bar comprising an elongated outer shell with open ends, the shell defining a hollow interior, and a foamed filler substantially filling the interior of the shell between the ends thereof.

The foam filler can be a material selected from the group consisting of urethane, urea formaldehyde, and styrene. The shell can be formed of a material selected from the group consisting of aluminum, steel, plastic, and glass-reinforced thermosetting resin. Preferably, the shell is roll-formed aluminum.

The muntin bar can be for interconnection with a peripheral frame that has a series of holes, the muntin bar further comprising an end-pin assembly comprising (i) a spike inserted into the foam filler through one of the open ends of the muntin bar, and (ii) a pin for insertion into one of the holes in the peripheral frame to connect the muntin bar to the peripheral frame.

The muntin bar can have a notch being configured to interfit with a complementary notch of another, similarly configured muntin bar when the muntin bar and the other muntin bar are overlapped. Further, the shell of the muntin bar can be substantially rectangular and comprise a pair of substantially parallel faces and a pair of substantially parallel sides. A bottom of the notch of the muntin bar is defined by a surface of the foamed filler. The surface of the foamed filler at the bottom of the notch of the muntin bar can extend from one of the sides to the other of the sides of the shell and be substantially parallel to the faces of the shell.

The muntin bar can further comprise a joining pin assembly including a pair of projections, one of the projections being insertable through the surface of the foamed filler, the other of the projections extending in a substantially opposite direction from the one of the projections for insertion into the other muntin bar when the muntin bar and the other muntin bar are overlapped.

In another aspect, the present invention relates to a decorative window assembly including a peripheral frame; and a plurality of elongated muntin bars interconnected in a grid which is connected to the peripheral frame, each muntin bar having (i) an elongated outer shell with open ends, the shell defining a hollow interior, and (ii) a foamed filler substantially filling the interior of the shell between the ends thereof.

In another aspect, the present invention relates to a decorative window assembly comprising a peripheral frame and a plurality of elongated muntin bars interconnected in a grid which is connected to the peripheral frame. Each muntin bar includes (i) an elongated outer shell with open ends, the shell defining a hollow interior, and (ii) a foamed filler substantially filling the interior of the shell between the ends thereof. Each of a pair of the muntin bars has a notch intermediate the ends thereof, and the pair of muntin bars is overlapped so the notches interfit with one another. The overlapped pair of muntin bars can be held together by adhesive where the notches interfit.

In another aspect, the present invention relates to a method of forming a foam-filled decorative muntin bar, including the steps of: roll-forming a sheet of aluminum to form a hollow outer shell; depositing a mixture of foaming components on the sheet of aluminum as it is being roll-formed, so the outer shell encases the mixture; allowing the mixture to react, expand and harden to form a foamed material that substantially fills the shell; and cutting the filled shell to form a segment of a foam-filled decorative muntin bar of desired length with open ends.

In yet another aspect, the mixture of foaming components can be deposited into the segments after the sheet of aluminum has been roll-formed and cut.

These and other objects, features and advantages of the present invention will be better understood with reference to the following figures, in which like numerals refer to the like elements.

DETAILED DESCRIPTION

Figure 1:
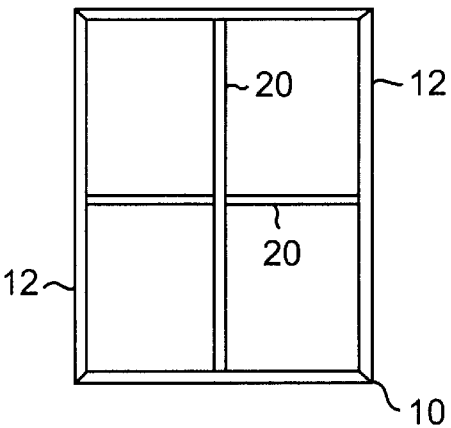
FIG. 1 is a front elevational view of a window incorporating a muntin bar assembly of the present invention.

FIG. 1 shows an embodiment of a muntin bar assembly of the present invention, which includes a peripheral frame 10 and a plurality of muntin bars 20 interconnected in a grid which is connected to the frame 10. For convenience and clarity, the present invention will be discussed in the context of an insulated glass (IG) unit, in which case the frame 10 is made up of a plurality of interconnected spacer bars 12, which sit between panes of glass in the IG unit. However, the muntin bars of this invention can be used with window assemblies other than IG units, and the frame can be mounted to the exterior or interior surface of the window or window assembly, rather than between the sheets of glass. Of course, the muntin bars of this invention can be used with other types of assemblies, which provide the desired effect.

Figure 2:
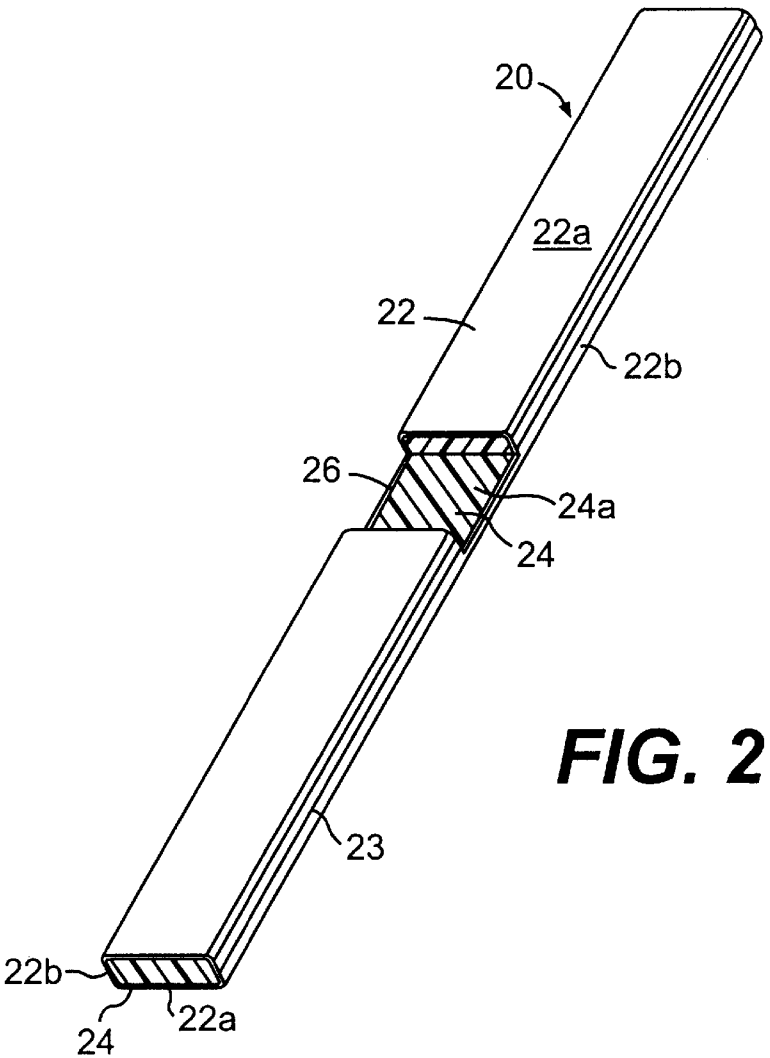
FIG. 2 is a perspective view of a muntin bar of the present invention.

FIG. 2 shows an embodiment of a muntin bar 20 of this invention. The bar 20 includes a shell 22 which is similar in many respects to those generally known in the art, and which defines a hollow interior. In this embodiment, the shell 22 has a rectangular cross section, defined by two parallel faces 22*a* and two parallel sides 22*b*. The cross section of the shell 22 need not be rectangular, but can be of any desired shape. The shell 22 is preferably roll-formed aluminum, which has been painted or anodized. Accordingly, the shell 22 includes a seam 23 in one of its sides 22*b*. The shell can alternately be formed of sheet steel, another suitable metal, or a suitable plastic or other material, such as glass-reinforced thermosetting resin, and can be extruded or pultruded.

In this embodiment, intermediate the ends of the bar 20, is a notch 26 for interfitting with an overlapping bar. The muntin bar 20 of this invention need not, however, be notched as shown in FIG. 2, if intended for use with joining elements in a non-overlapping grid arrangement. If the bars 20 are notched for overlapping, however, it is preferred that the shells 22 of overlapping bars have similar rectangular cross sections, and that the notches 26 extend approximately, or slightly greater than, half way across both sides 22*b* of the shell. Thus, when the bars 20 are interfit, the respective faces 22*a* will be approximately flush. It is also preferred that the respective notches be of complementary depth to facilitate the interfit. Production of the muntin bars can be simplified if the notches are substantially uniform in depth.

If the bars 20 are to overlap at right angles, then each notch should be approximately rectangular, i.e., defined by edges which extend straight across one face 22*a* of the bar 20. If the bars are to intersect at another angle, then the notch should be an approximate parallelogram, with edges extending across the faces 22*a* at an appropriate angle.

Unlike known muntin bars, the interior of the bar 20 of this embodiment is filled with a foamed filler 24. The filler 24 is preferably a foamed plastic, and most preferably is formed of a foamed urethane. A foaming material available under the name Vultaform from General Latex Canada Inc. has proven to be particularly well-suited for us as the filler 24. Alternatively, urea formaldehyde, styrene or other suitable foamed plastic may be used. Also, any material which can be easily manipulated in liquid or semi-liquid form, and which solidifies and remains solid at likely operating temperatures, can be used as a filler, such as, for example, concrete, cement, plaster, resin, wood-filled resin, hot melt resins, polymers and wood-filled polymers, and clay. However, due to their ease of production and manipulation, and their relative lightness, foamed plastics are preferred. Of these, foamed urethane is preferred because it is relatively inexpensive, rigid, and quick to foam and harden.

In the case of an IG unit, or any window assembly in which the muntin bars are disposed between panes of glass, there is an additional concern. With many foamed materials, over time, small amounts of gas will escape from the structure of the material in a process called outgassing. This gas, if released from a foamed material sandwiched between window panes, could cause the glass to fog. However, in IG units with foam-filled muntin bars disposed between panes of glass, foamed urethane has proven to be a suitable filler material because it has not presented serious outgassing problems.

In production, the filler material can be introduced to the muntin bar during roll formation or in a separate, later process. In the preferred embodiment, the filler material is deposited on the aluminum as it is roll-formed, just prior to closing of the seam 23. The amount of foamed material should be selected to substantially fill the internal volume of the rolled bar, i.e., fill more than about three-quarters of the volume.

Depending on the filler material selected, the filler material can be introduced to the bar structure before, during, or after foaming, as will be appreciated by those of ordinary skill in the art. For example, in the case of a filler material that is foamed by the generation of gas due to a chemical reaction during its formation or due to the addition of a blowing agent, or in the case of a material that is foamed by the introduction of gas prior to setting, then the necessary components of the filler material can be mixed on-line immediately prior to introduction to the bar. A material that is maintained under pressure, and which foams upon release of pressure, can be deposited directly onto the bar material. In another example, a filler material that foams upon the application of heat can be introduced to and then heated in place on the bar. Generally, a curing element can be provided just downstream of the roll former, in which the filler material is heated and/or cooled, depending upon the filler material and foaming process, in order to stabilize, or cure, the foamed material. During this process, the bar can be supported in order to maintain its shape. Once the foam is cured, the muntin bars can be cut into segments of desired length.

Figure 5B:
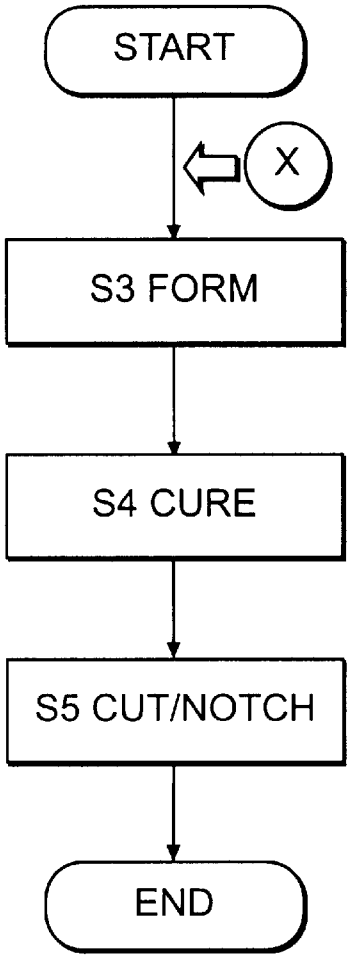
FIGS. 5A–5D are flow charts illustrating embodiments of a method of forming a muntin bar of the present invention.
Figure 5A:
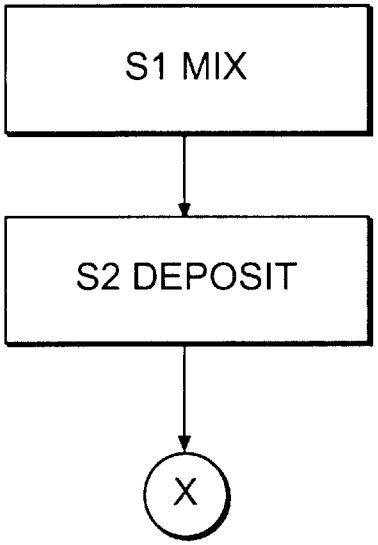
Figure 5D:
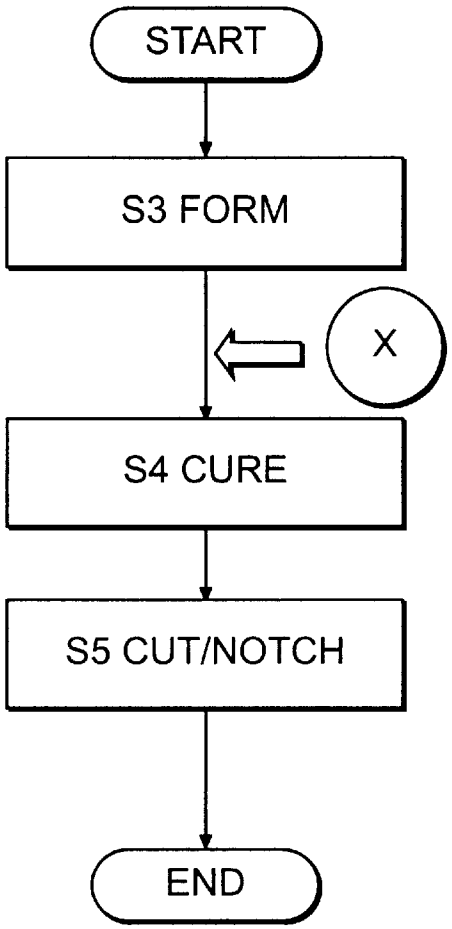
Figure 5C:
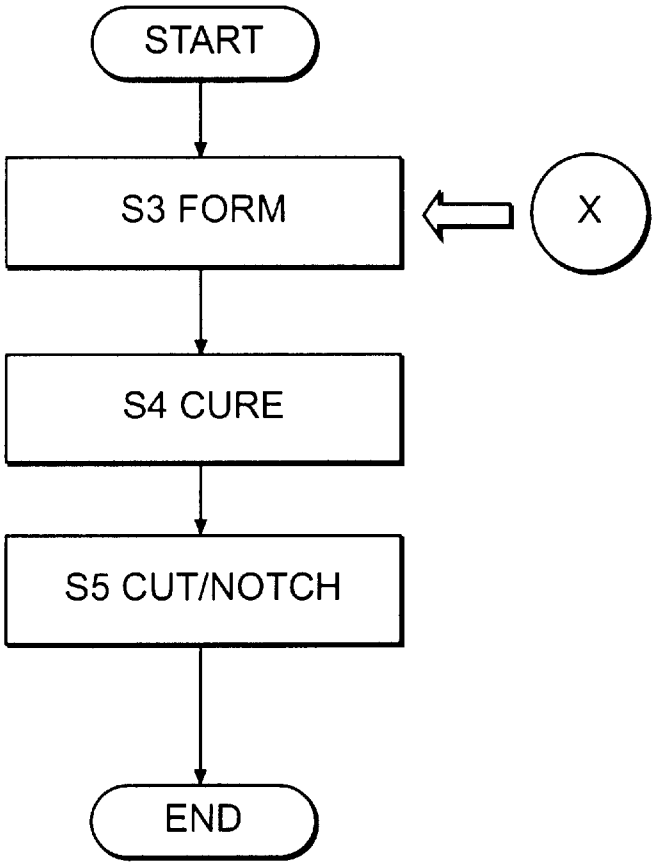

With foamed urethane, the process, illustrated in FIGS. 5A–5D, typically begins with two separate components, generally referred to in the art as A and B, preferably a polyol and an aromatic diisocyanate, such as methylene diisocyanate (MDI). As shown in FIG. 5A, the components are preferably mixed together (Step S1) with a blowing agent, such as freon or (preferably) water, and deposited on the aluminum (Step S2). This can be done before, during, or after the roll-forming of the aluminum (Step S3), as indicated by the alternate occurrences of X in FIGS. 5B–5D. Economic factors favor a continuous process in which the injection is done during roll-forming. In the most preferred embodiment, the mixed forming components are injected into the partially roll-formed aluminum shell, just prior to closure of the ends of the bar to create the seam. It is preferred that the injection be done after completion of the roll-forming steps requiring manipulation of the side of the aluminum that will be the interior of the shell, to avoid contact of the tools with the foam. The physical size of the injection nozzle dictates how much space is required in the seam for injection, and therefore, how late in the roll-forming process the injection can be done.

The components combine in an exothermic reaction that produces urethane plastic, as well as "vapor" in the solution, which expands the plastic. No separate mechanism is necessary to assist the curing. The plastic foams and hardens (Step S4) in the shell shortly after the components are mixed, generally within about a minute. The density of the foam can be controlled (typically in a range between approximately 6 and 20 $lb/ft^3$) by adjusting the amount of blowing agent in a manner well known in the art.

As noted earlier, the foam-filled muntin bar 20 of the present invention applies to muntin bars with or without notches. In the case of the overlapping type muntin bars, the notches are preferably formed once the filler material has been deposited and stabilized. The bar can be notched in any of a number of ways known in the art, for example by stamping with a notching jig, milling, routing, or cutting with a water jet, laser or the like. The notching can be done before or after the muntin bars have been cut into segments of desired length. This is indicated by Step S5 in FIG. 5. In the embodiment shown, notching the foam-filled muntin bar results in a filler surface 24*a*, at the bottom of the notch 26, which is substantially parallel to the faces 22*a* of the bar 20.

The foam-filled muntin bar of the present invention has several advantages. First, the filler material reinforces the muntin bar, increasing its strength. Thus, less damage will occur to the surrounding bar material during notching. Also, the bar is more resistant to seam spreading due to the pressure from the end-pin assembly. The bar is also more resistant to buckling or twisting prior to and during installation.

With the foam filler, the thickness of the aluminum sheets used to form the shell can be greatly reduced. The degree to which the thickness can be reduced depends on the density of the foamed material. The denser the foamed material is, the thinner the shell wall can be. For example, traditional rectangular, notched muntin bars, in order to provide sufficient rigidity, are generally formed from sheets of aluminum at least 0.020 inch thick. A similarly shaped, foam-filled muntin bar of this invention, formed from 0.014 inch thick aluminum and filled with foamed urethane at a density of 12 $lb/ft^3$, exhibits for superior torsional rigidity than do traditional, 0.020 inch muntin bars. In this invention, foam-filled rectangular, notched muntin bars can be formed from sheets that are less than 0.010 inch thick and still be as strong or stronger torsionally. Structurally, by sufficiently increasing the density of the foamed filler, it is possible to make such bars from aluminum sheets that are foil thin (i.e., in the order of 0.005 inch thick) or even from a plastic film, so that the shell becomes less structural and more decorative. Thus, it is also possible to select a shell material that does not have the same structural rigidity or strength as aluminum, but is less thermally conductive than aluminum, thereby reducing the impact on the thermally insulative properties of an IG unit.

As a matter of commercial practicality, however, sheets of 0.011 to 0.0125 inch aluminum are generally less expensive and easier to manipulate than are thinner sheets, so it is often more economical to use this thickness. Using even the 0.011 to 0.0125 inch aluminum in this invention significantly reduces the cost and improves the aesthetics of the muntin bar, and results in a bar that is to a degree less detrimental to the thermal insulative properties of an IG unit. Further, the foam-filled muntin bar has better flexural characteristics, decreasing the likelihood of plastic deformation.

Figure 3A:
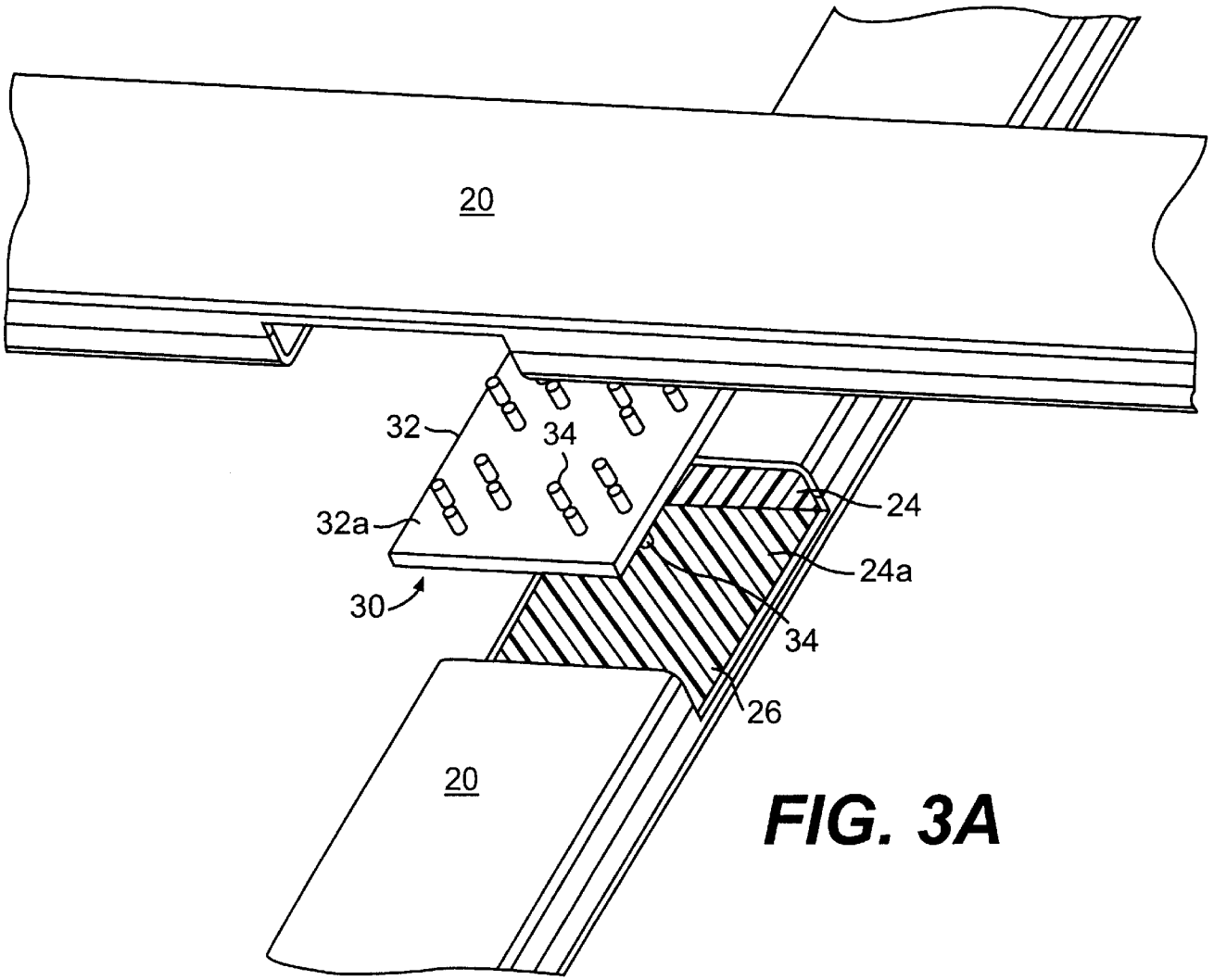
FIG. 3A is a detailed, exploded perspective view of an interconnecting region of two muntin bars of the present invention showing a double-sided joining pin of the present invention.
Figure 3B:
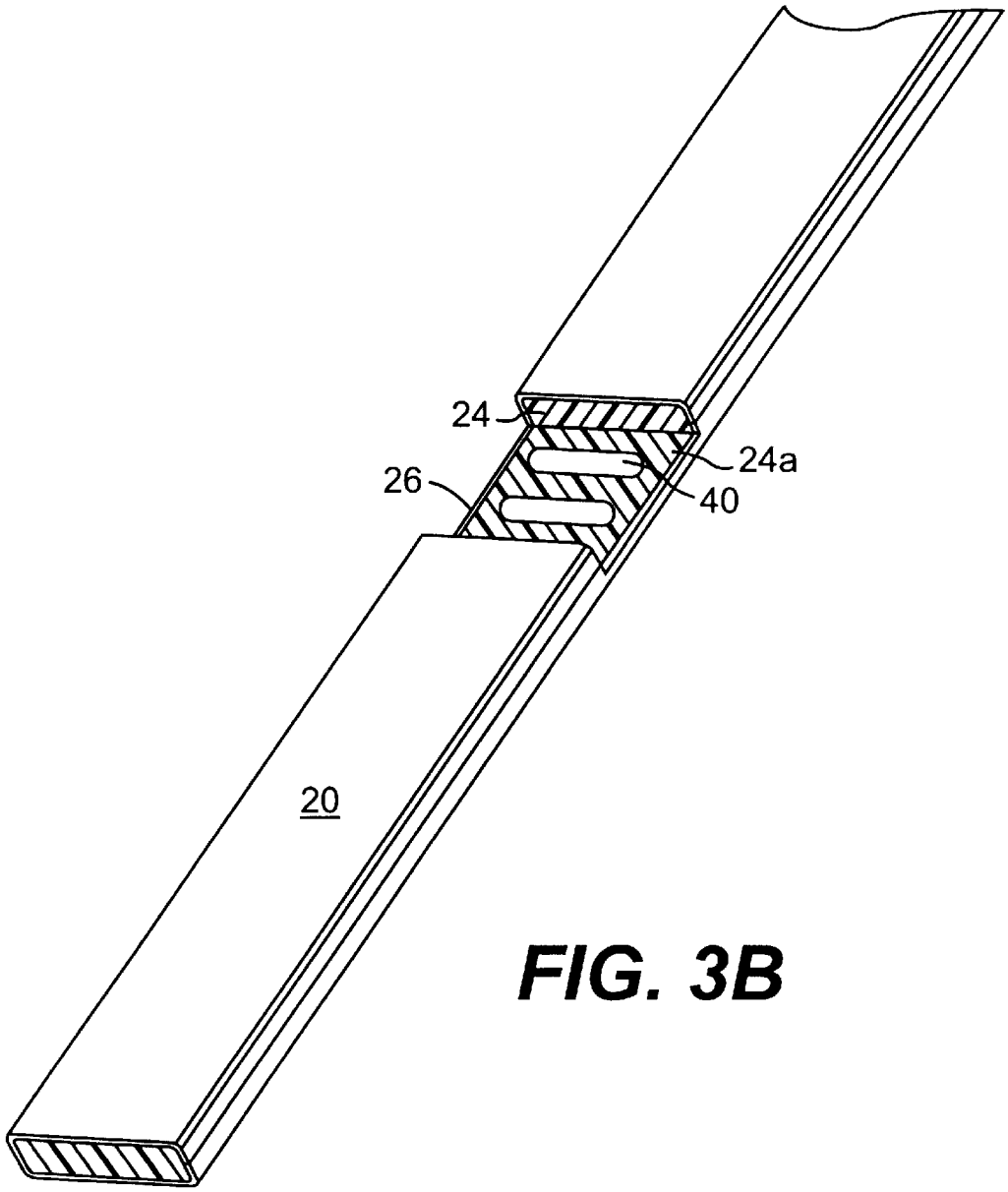
FIG. 3B is a detailed, exploded perspective view of an interconnecting region of two muntin bars of the present invention showing an alternate joinder mechanism.

FIGS. 3A and 3B illustrate how the foam-filled muntin bar 20 of the present invention facilitates simplified joinder of notched, overlapping muntin bars. FIG. 3A illustrates the joinder of two overlapping muntin bars using a double-sided joining pin assembly 30. The joining pin assembly 30 has a base 32 and projections 34 that project from either face 32*a* of the base 32. The projections 34 can be pressed through the surface 24*a* of the foamed filler 24 at the bottom of the notch 26 of each bar, holding the bars together. In an alternate form, the joining pin 30 can be configured without a base 32. For example, an elongated pin can be employed, with projections at either end for insertion into the foamed filler of a respective bar. To improve the hold, the projections 34 can be pointed and/or barbed.

FIG. 3B illustrates another approach, in which the practical advantages of the foam-filled muntin bar of the present invention are evident. Here, an adhesive 40, for example, is placed on the surface 24*a* of the foamed filler 24 at the notch 26. An adhesive should be selected that will provide adequate holding strength at expected service temperatures and will not present outgassing problems. While any of a number of adhesives are acceptable, hot melt adhesives, particularly the polyamide and polyester families of adhesives, have exhibited acceptable characteristics and are therefore preferred. In order to provide a sufficient margin of safety over the likely conditions that must be endured in a window unit, it is preferred that the adhesive have a heat resistance temperature of at least about 100° C., more preferably 110° C. Some examples of acceptable polyamide adhesives are the Macromelt 6200 series, commercially available from Henkel Corporation (Elbin, Ill.), with Macromelt 6202 being preferred. Because the foamed filler is thermally set, hot liquid adhesive can be applied to the surface 24*a* without melting the foamed filler 24. The adhesive 40 will seep into the porous surface 24*a* of the foamed filler 24, increasing the strength of the structural bond.

In either case, with a double-sided joining pin or with adhesive, the complexity and the cost of interconnecting the bars into an assembly is greatly reduced. Either the joining pin 20 or the adhesive 40 can be placed on the filler surface 24*a* of one bar, and the other bar placed in its overlapped position. Then, the two bars can simply be pressed together. Especially in the case of adhesive joinder, the bond formed at the joint can be considerably stronger than the foamed filler 24 itself.

Although I have discussed the use of a double-sided joining pin or an adhesive, other equivalent techniques likewise could be used to achieve the same effect.

Figure 4:
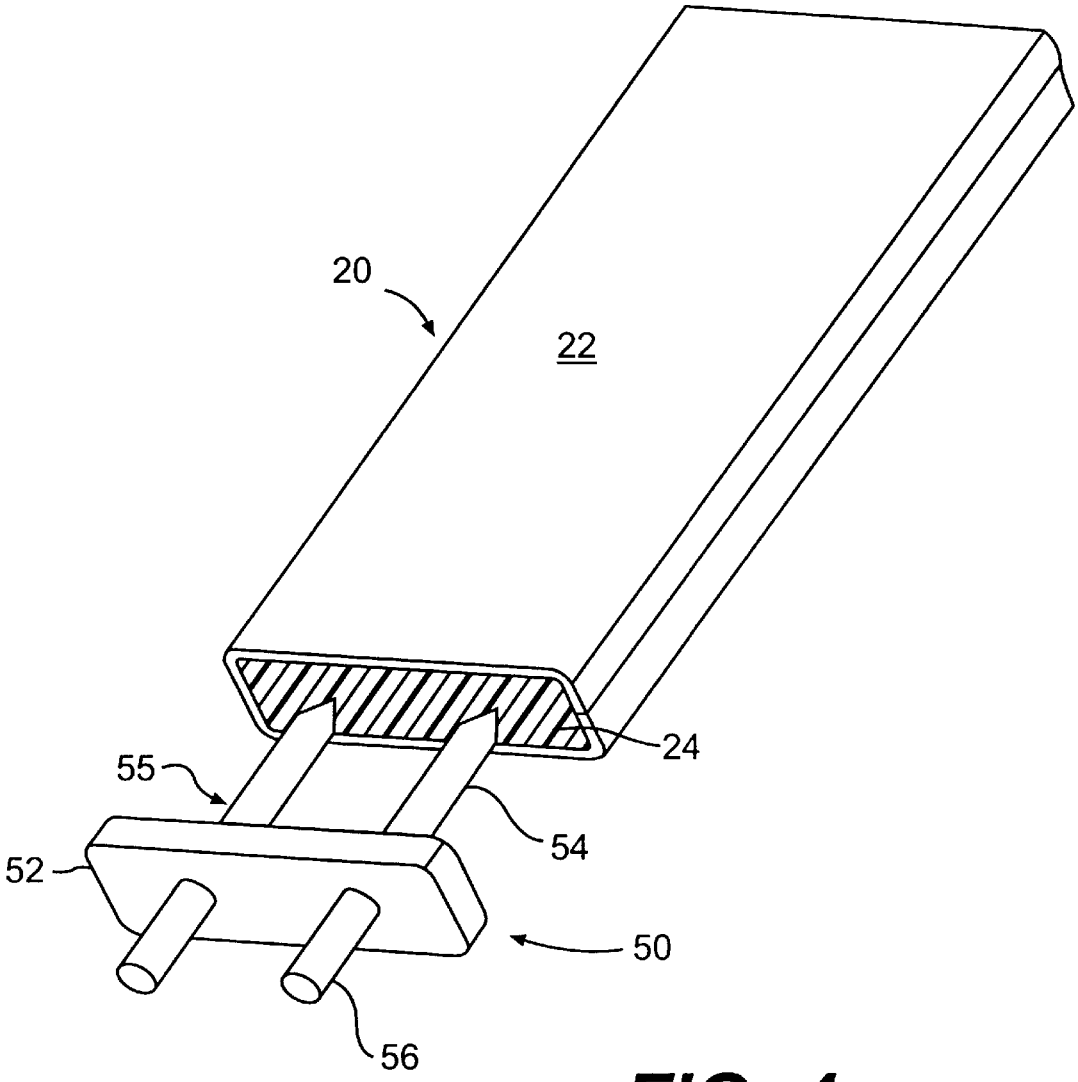
FIG. 4 is a detailed, exploded perspective view of an end of a muntin bar of the present invention, showing an end-pin assembly of the present invention.

FIG. 4 illustrates how the foam-filled muntin bar 20 of the present invention also overcomes the drawbacks in traditional end-pin assemblies. An end-pin assembly 50 can be provided with a flange 52 sized to fit within the shell 22 at the end of the muntin bar 20. Extending from one face can be spikes 54 or the like, which can be pressed into the foam filler at the end of the bar 20. Extending from the other face are pins 56 or the like for insertion into corresponding holes in the frame 10 (not shown in this figure). In this embodiment, the spikes 54 and pins 56 are at opposite ends of unitary, elongated dowels 55 which extend through the flange 52, although separate pieces can be used. In use, the end-pin assembly 50 can simply be pressed into the end of the bar 20 until the flange 52 sits against the foamed filler 24 within the shell 22. Because the foamed filler 24 prevents the end pin from sinking deeper into the bar 20, it is not necessary to provide a tight friction fit. Thus, the end-pin assembly of this invention imparts less spreading force to the seam 23 than do traditional end-pin assemblies. Further, because the flange 52 can engage the filler rather than the shell, the flange can be concealed in the end of the bar 20, improving the aesthetic appearance of the bar. A similar arrangement can be used in joining elements for non-overlapping joinder of muntin bar segments.

In another embodiment, the flange 52 can be omitted. The spike 54 end of the dowel 55 can be driven directly into the foam filler 25, with the pin 56 end extending outwardly. Also, more or fewer spikes 54 and end-pins 56 can be employed in the end-pin assembly 50. The spikes 54 and pins 56 can be shaped differently, as well. For example, the spikes can be blunt rather than pointed. Similarly, the pins 56 can be pointed rather than blunt. Also, the spikes or pins can have a different cross-sectional shape, such as square, and the spikes can be barbed if desired. The pins 56 can also be spring-loaded to facilitate insertion into the holes of the frame 10. In an alternate embodiment, the spikes 54 can be omitted altogether, and the end-pin assembly 50 can be affixed to the foam filler by adhesive or the like.

Because foam-filled muntin bars are more rugged than traditional muntin bars, and because they facilitate joinder with the peripheral frame and with one another, as discussed above, they are much easier than traditional decorative muntin bars to assemble into window assemblies. It is therefore practical to provide foam-filled muntin bar kits for use with varying-sized windows. In such a kit, a number of foam-filled muntin bars can be provided, with or without notches, along with a selection of end-pin assemblies, joining pins and/or adhesive. Because of the increased structural soundness and easier joinder mechanisms of the foam-filled muntin bars of this invention, the user can cut and notch (if necessary) the foam-filled muntin bars to a desired fit, and assemble the window assembly using the accessories. With traditional muntin bars, this would be highly impractical.

In the foregoing specification, a detailed description of the preferred embodiments of the present invention has been set forth for the purpose of illustration. Various modifications of and equivalent structures to the embodiments disclosed herein may be made by those skilled in the art without departing from the spirit and scope of the invention, as defined in the following claims. Also, the scope of the invention is not limited by the discussion above, but only by each of the following claims, which should be interpreted as broadly as possible to encompass all modifications and equivalent structures without encompassing the prior art or invalidating the claim.

I claim:

1. A method of forming a foam-filled decorative muntin bar, comprising the steps of:

roll-forming a sheet of aluminum to form a hollow outer shell;

depositing a mixture of foaming components on the sheet of aluminum as it is being roll-formed, so the outer shell encases the mixture;

allowing the mixture to react, expand and harden to form a foamed material that substantially fills the shell; and cutting the filled shell to form a segment of a foam-filled decorative muntin bar of desired length with open ends.

2. The method claim 1, wherein the hollow shell is formed to have a substantially rectangular cross section defined by a pair of substantially parallel faces and a pair of substantially parallel sides.

3. The method claim 2, further comprising notching the segment between its open ends to form a notch having a bottom defined by a surface of the foamed material, the surface being substantially parallel to the faces of the shell and extending from one of the sides to the other of the sides of the shell.

4. The method claim 2, further comprising, prior to cutting the shell, notching the shell to form a notch having a bottom defined by a surface of the foamed material, the surface being substantially parallel to the faces of the shell and extending from one of the sides to the other of the sides of the shell, wherein the notch is positioned between the open ends of the segment after the step of cutting the shell is completed.

5. The method claim 1, further comprising attaching an end-pin assembly to each open end of the segment, each end-pin assembly comprising (i) a spike which is inserted into the foamed material through the open end of the segment, and (ii) a pin extending in substantially the opposite direction from the spike for insertion into a receiving hole in a window frame.

6. The method of claim 1, wherein the foamed material is selected from the group consisting of urethane, urea formaldehyde, and styrene.

7. The method of claim 1, wherein the foamed material is urethane.

* * * * *